US007100218B2

(12) United States Patent
Wooldridge et al.

(10) Patent No.: US 7,100,218 B2
(45) Date of Patent: Sep. 5, 2006

(54) LIFTING LEVER FOR A CISTERN FLUSH VALVE

(75) Inventors: Colin William Wooldridge, Modbury (AU); Sam Robertson England, Marden (AU)

(73) Assignee: Caroma Industries Limited, Brisbane (AU)

( * ) Notice: Subject to any disclaimer, the term of this patent is extended or adjusted under 35 U.S.C. 154(b) by 0 days.

(21) Appl. No.: 10/527,148

(22) PCT Filed: Aug. 28, 2003

(86) PCT No.: PCT/AU03/01108

§ 371 (c)(1),
(2), (4) Date: Jan. 26, 2006

(87) PCT Pub. No.: WO2004/027174

PCT Pub. Date: Apr. 1, 2004

(65) Prior Publication Data

US 2006/0130224 A1 Jun. 22, 2006

(30) Foreign Application Priority Data

Sep. 19, 2002 (AU) ..... 2002951506

(51) Int. Cl.
*E03D 5/00* (2006.01)

(52) U.S. Cl. ..... 4/405; 4/410

(58) Field of Classification Search ..... 4/405, 4/407, 410–414
See application file for complete search history.

(56) References Cited

U.S. PATENT DOCUMENTS 5,933,878 A * 8/1999 Suehiro et al. ..... 4/405

FOREIGN PATENT DOCUMENTS

| | | | |
|---|---|---|---|
| AU | A-76442/91 | | 5/1991 |
| DE | 101 32 598 | A1 | 7/2001 |
| EP | 426224 | A1 * | 5/1991 |
| EP | 0 913 532 | A2 | 10/1998 |

* cited by examiner

*Primary Examiner*—Tuan Nguyen
(74) *Attorney, Agent, or Firm*—Merchant & Gould P.C.

(57) ABSTRACT

A lifting lever (10) for a cistern flush valve. The lever includes a first end (14) adapted for operative engagement with the cistern flush valve, a second end (18) adapted for operative engagement with a flush actuation button (24) and a pivot mounting (28) between the first (14) and second (18) ends. The second end (18) has first and second engagement regions (32, 34) which are respectively closer and farther to the pivot mounting (28). Initial movement of the button (24) causes it to engage the second engagement region (34) and pivot the lever (10) through a first predetermined range of movement whereafter further movement of the button (24) in the same direction causes it to engage the first engagement region (32) and further pivot the lever (10).

8 Claims, 2 Drawing Sheets

LIFTING LEVER FOR A CISTERN FLUSH VALVE

FIELD OF THE INVENTION

The present invention relates to a lifting lever for a cistern flush valve. A cistern is known as a flush tank in the United States of America.

BACKGROUND OF THE INVENTION

Cistern flush valves are usually actuated by depressing a button in the lid of the cistern. A lever arrangement within the cistern then converts the downward movement of the button into an upward movement of the cistern flush valve.

It is known to introduce mechanical advantage between the movement of the actuation button and the responsive movement of the flush valve. If the mechanical advantage is too low, then excessive force may be needed on the button in order to initially lift the valve and break its seal. If the mechanical advantage is too high, then an excessive amount of button travel may be required to sufficiently lift the flush valve.

It is an object of the present invention to provide a lifting lever that combines an acceptable button force with an acceptable flush valve travel.

SUMMARY OF THE INVENTION

A lifting lever for a cistern flush valve, the lever including:

a first end adapted for operative engagement with the cistern flush valve;

a second end adapted for operative engagement with a flush actuation button; and a pivot mounting between the first and second ends, wherein the second end has first and second engagement regions which are respectively closer and farther to the pivot mounting such that initial movement of the button causes it to engage the second engagement region and pivot the lever through a first predetermined range of movement whereafter further movement of the button in the same direction causes it to engage the first engagement region and further pivot the lever.

The first and second engagement regions are preferably in the form of first and second external corners on the lever second end. The first and second corners preferably have a straight joining surface therebetween.

The pivot mounting is preferably adapted to mount the lever to a bridge forming part of, or connected to, a cistern.

The lever is preferably formed from a first and a second part. The first and second parts preferably include the first and second ends respectively. The first and second parts are preferably fixed together adjacent the pivot mounting.

The button is preferably constrained to travel along a straight path that is parallel to the tangent of the path of motion of the first and second engagement regions.

BRIEF DESCRIPTION OF THE DRAWINGS

A preferred embodiment of the invention will now be described, by way of example only, with reference to the accompanying drawings in which.

DETAILED DESCRIPTION OF THE PREFERRED EMBODIMENT

Figure 1:
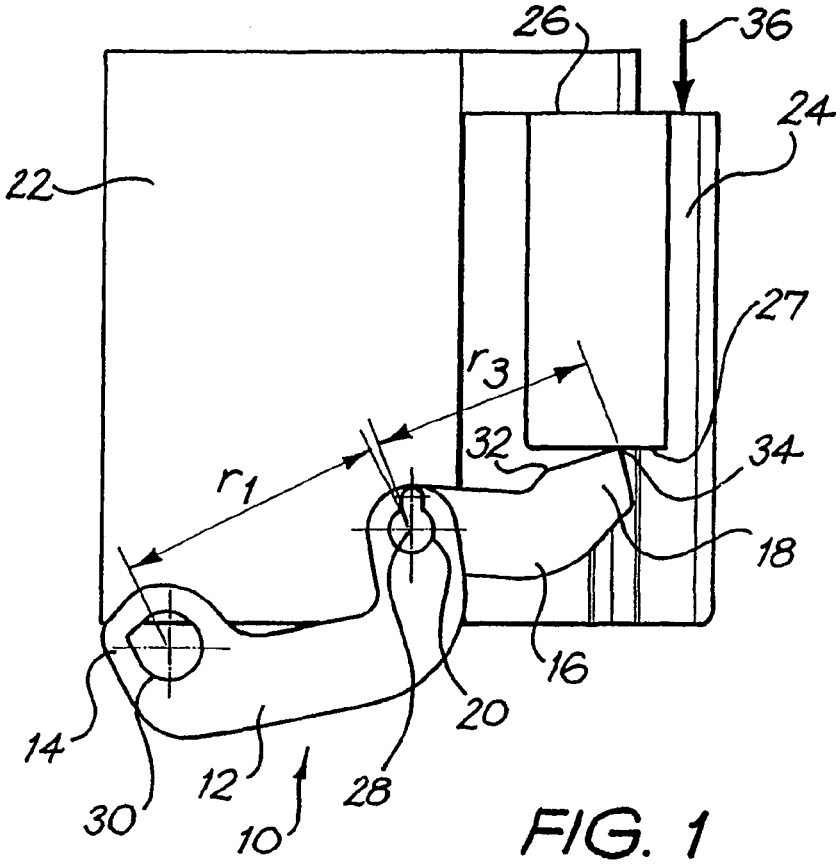
FIG. 1 is a schematic side view of an embodiment of a lifting lever according to the invention, before flush actuation.

Referring firstly to FIG. 1, there is shown an embodiment of a lifting lever 10 for a cistern flush valve (not shown). The lever is comprised of a first part 12 having a first end 14 and a second part 16 having a second end 18. The first and second parts 14, 16 are joined together at 20 in such a manner so as to not pivot relative to each other. FIG. 1 also shows a bridge 22 which can form part of, or be attached to, a cistern (not shown). Also shown is an actuation button 24 which has an actuation surface 26, which is accessible through the lid (not shown) of the cistern, and a driving surface 27. The lever 10 is pivotally mounted to the bridge 22 so as to pivot about axis 28. The button 24 is constrained to move along a substantially straight line in an up and down direction.

The first end 14 of the lever 10 has an opening 30 which is adapted for operative engagement with a cistern flush valve (not shown). The second end 18 of the lever 10 has first and second engagement regions, in the form of first and second corners 32 and 34. The radial distance from the axis 28 to the opening 30 is denoted r1. The radial distance from the axis 28 to the first corner 32 is denoted r2. The radial distance from the axis 28 to the second corner 34 is denoted r3. In the embodiment shown, the ratios r1:r2 and r1:r3 are approximately 2.0:1 and 1.2:1 respectively.

The operation of the lever 10 will now be described. FIG. 1 shows the lever 10 before actuation of the flush valve in which the first end 14 is at its lowest point and the second end 18 is at its highest point. In this position, the second corner 34 of lever second end 18 abuts and engages the driving surface 27 of the button 24. When the button 24 is depressed in the direction of arrow 36 from the position shown in FIG. 1 to the position shown in FIG. 2, the second end 18 is driven down and the first end 14 is driven up to actuate the flush valve by initially breaking the seal of the flush valve. The mechanical advantage provided by engagement of the second corner 34 with the driving surface 27 of button 24 is approximately 1.2:1.

Figure 2:
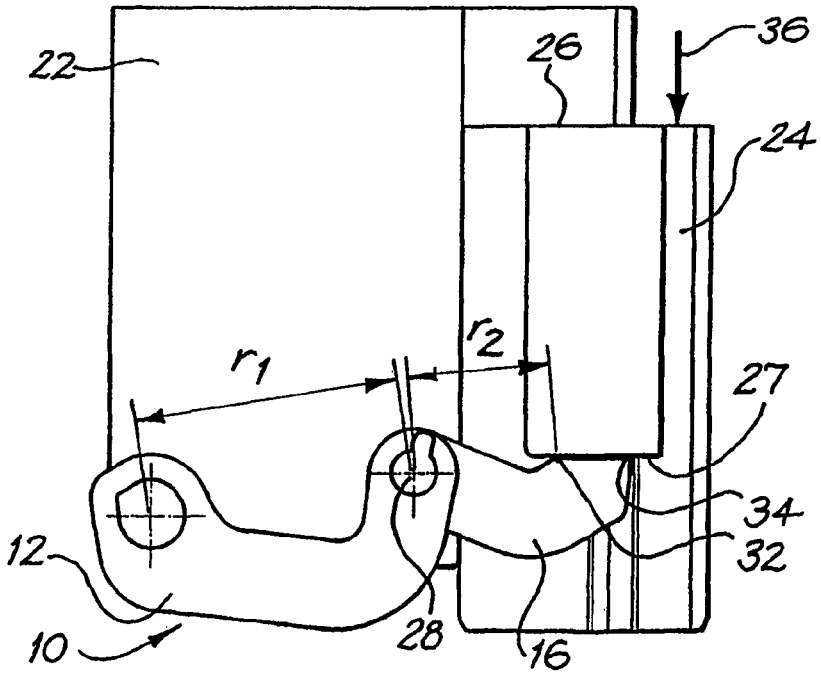
FIG. 2 is a schematic side view of the lever shown in FIG. 1 during initial flush actuation.
Figure 3:
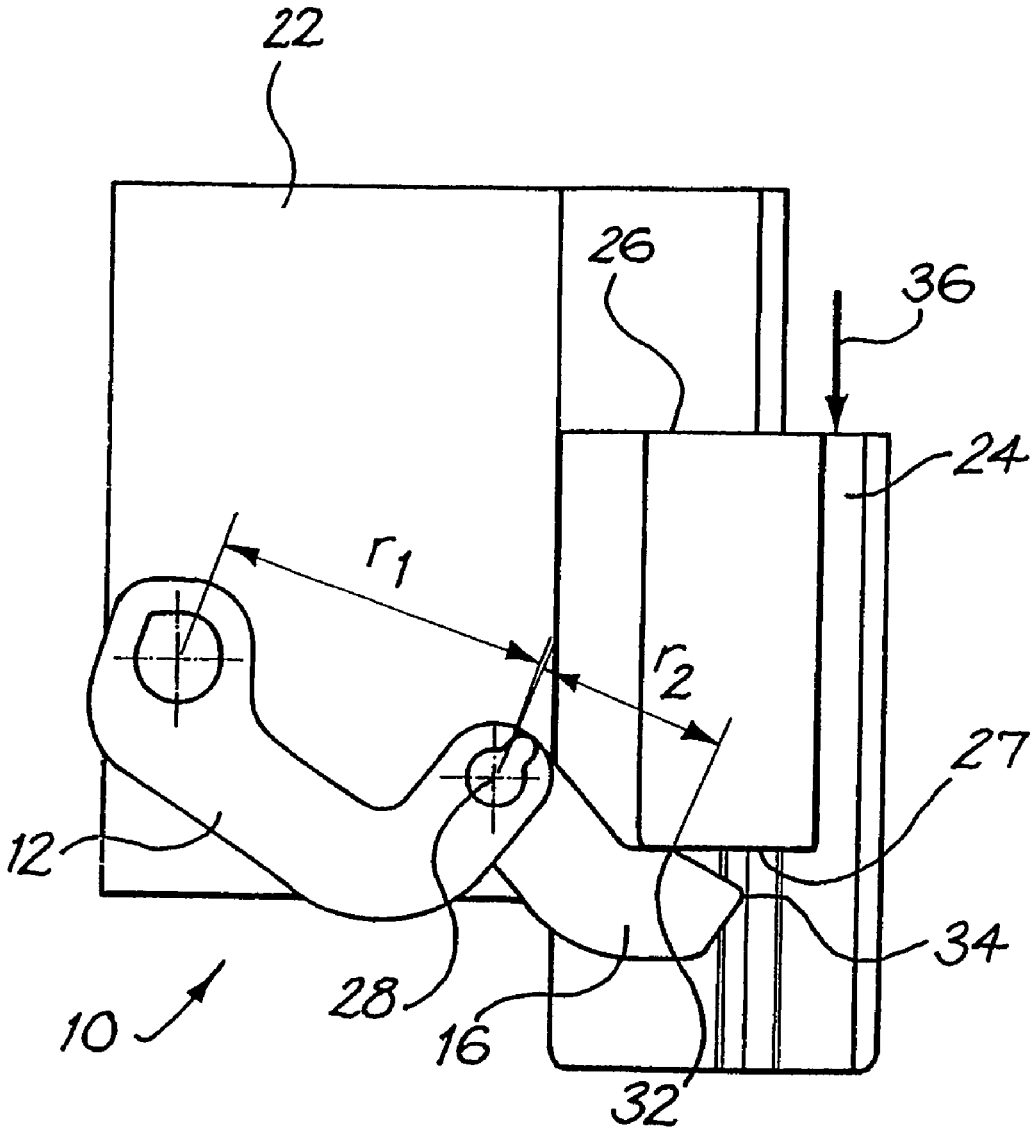
FIG. 3 is a schematic side view of the lever shown in FIG. 1 with continued actuation from that shown in FIG. 2.

When the button is at the position shown in FIG. 2, the driving surface 27 is in abutment and engagement with the first corner 32 of the lever second end 18. Continued movement of the button 24 in the direction of arrow 36 from the position shown in FIG. 2 to FIG. 3 continues to drive the second end 18 downwards and the first end of the lever 14 upwards. However, during this movement, the mechanical advantage from the movement of the button 24 to the movement of the valve is greater at 2.0:1.

In the preferred embodiment, the corners 32 and 34 are arranged such that the lower mechanical advantage is experienced during the first few millimetres of valve opening and the higher mechanical advantage is then experienced until a total valve displacement of about 20 mm has occurred.

Accordingly, the lifting lever 10 provides a higher amount of mechanical advantage during initial movement of the button 24 and thus generates a relatively higher lifting force during this initial movement. This is beneficial whilst opening an outlet valve as the forces required are initially quite high in order to lift the valve off its seat and break its seal. However, once the seal has been broken, the forces required to continue to lift the valve decrease considerably and, during this movement, the mechanical advantage (ie. the lever ratio) provided by the lever increases to 2:1 to advantageously achieve a relatively high lift of the cistern valve compared to the travel of the button.

The lifting lever 10 therefore allows the valve to be actuated without requiring an excessive actuation force whilst still providing a sufficient amount of lift.

Although the invention has been described with reference to a preferred embodiment, it will be appreciated by those skilled in the art that the invention may be embodied in many other forms. For example, although the preferred embodiment was described in relation to push button style cistern actuation, the invention is also suitable for use with lever style cistern actuation.

The invention claimed is:

1. A lifting lever for a cistern flush valve, the lever including: a first end adapted for operative engagement with the cistern flush valve; a second end adapted for operative engagement with a flush actuation button; and a pivot mounting between the first and second ends, wherein the second end has first and second engagement regions which are respectively closer and farther to the pivot mounting such that initial movement of the button causes it to engage the second engagement region and pivot the lever through a first predetermined range of movement whereafter further movement of the button in the same direction causes it to engage the first engagement region and further pivot the lever.

2. The lever as claimed in claim 1, wherein the first and second engagement regions are in the form of first and second external corners on the lever second end.

3. The lever as claimed in claim 2, wherein the first and second corners have a straight joining surface therebetween.

4. The lever as claimed in claim 1, wherein the pivot mounting is adapted to mount the lever to a bridge forming part of, or connected to, a cistern.

5. The lever as claimed in claim 1, wherein the lever is formed from a first and a second part.

6. The lever as claimed in claim 5, wherein the first and second parts include the first and second ends respectively.

7. The lever as claimed in claim 5, wherein the first and second parts are fixed together adjacent the pivot mounting.

8. The lever as claimed in claim 1, wherein the button is constrained to travel along a straight path that is parallel to the tangent of the path of motion of the first and second engagement regions.

* * * * *